US005169376A

United States Patent [19]

Ries et al.

[11] Patent Number: 5,169,376

[45] Date of Patent: Dec. 8, 1992

[54] DEVICE FOR FOLDING SHEETS

[75] Inventors: Juergen Ries, Nellingen; Bruno Scherr, Weilheim-Teck, both of Fed. Rep. of Germany

[73] Assignee: Eastman Kodak Company, Rochester, N.Y.

[21] Appl. No.: 787,288

[22] Filed: Nov. 4, 1991

[30] Foreign Application Priority Data

Jan. 18, 1991 [DE] Fed. Rep. of Germany ..... 4101399

[51] Int. Cl.[5] ..... B65H 45/16

[52] U.S. Cl. ..... 493/445; 493/435

[58] Field of Search ..... 493/434, 435, 437, 442, 493/443, 444, 445, 454, 423, 424

[56] References Cited

U.S. PATENT DOCUMENTS

| | | | |
|---|---|---|---|
| 141,405 | 7/1873 | Upton | 493/444 |
| 907,122 | 12/1908 | Bray | 493/445 |
| 941,747 | 11/1909 | Wallace | 493/444 |
| 948,117 | 2/1910 | Tonlinson | 493/445 |

*Primary Examiner*—Bruce M. Kisliuk

*Assistant Examiner*—Jack Lavinder

*Attorney, Agent, or Firm*—Lawrence P. Kessler

[57] ABSTRACT

A sheet-folding device having pairs of prefolding and pressure rollers (3, 4 and 8, 9, respectively) of identical diameters successively arranged for rotation in a machine frame (1). A first pressure roller (8) is stationarily mounted to machine frame (1) for rotation, whereas the first prefolding roller (3) is rotatably mounted on spring-urged support members (10) which are slidable normally to the folding direction (A). The second prefolding roller (4) is mounted for rotation on shaft (14), said shaft being supported in lever arms (15) pivotally mounted to machine frame (1). Connecting arms (21) are hinged to the shaft (14) to support the second pressure roller (9) for rotation on shaft (13). The connecting arms (21) are urged by springs (18) such that, during feed-in of a prefolded stack into the nip of pressure rollers (8, 9), the springs (18) are compressed by pivoting the connecting arms (21) in a way that the pressure of the second prefolding roller (4) is increased and, thus the frictional forces exerted on the stack are enhanced.

4 Claims, 2 Drawing Sheets

DEVICE FOR FOLDING SHEETS

BACKGROUND OF THE INVENTION

The present invention relates, in general, to a device for folding at least one sheet and, more particularly, to a sheet-folding device including driven prefolding and pressure rollers as well as a folding bar pushing the sheet into the nip of the prefolding rollers by deforming it in the folding station to take a V-shape.

In known sheet-folding devices such as shown in DE-PS 365 688, a sheet to be folded is moved into the nip of prefolding rollers by a striker, the rollers feeding the sheet when prefolded to pressure rollers for completing the folding process. If a stack of sheets consisting of a plurality of sheets is to be folded, the pressure rollers which for thickness compensation must be spring-urged against each other offer the prefolded stack of sheets considerable resistance which may damage the sheets or cause malfunctions (such as sheet-to-sheet misalignment).

SUMMARY OF THE INVENTION

This invention is directed to a sheet-folding device wherein both a single sheet and a plurality of sheets forming a stack can be folded without causing any sheet damage or malfunctions. The sheet-folding device, according to this invention, includes prefolding rollers and pressure rollers arranged in pairs parallel to each other and rotatably mounted, successively, in a folding direction. A first pressure roller of the pair of pressure rollers is rotatably supported on a stationary shaft. The first rotatable prefolding roller, arranged on the same side of the folding path as the first pressure roller, is stationarily mounted relative to the folding direction and urged by a spring movably mounted normally thereto. The second prefolding roller and the second pressure roller are rotatably mounted on connecting arms, the second prefolding roller being stationarily rotatable and movable normally thereto. Springs arranged between the second prefolding roller and the second pressure roller and urging them toward the first prefolding roller and the first pressure roller, respectively, engage the connecting arms such that the pressure force of the second prefolding roller is increased by tensioning the springs when sheets to be folded move into the nip of the pressure rollers.

In an advantageous embodiment of the invention, the second prefolding roller is supported by the free ends of stationarily and pivotally mounted lever arms. This arrangement enables the first prefolding roller and the first pressure roller to be moved away from each other to the extent that a possible malfunction can easily be eliminated by pivoting the lever arms. The folding device, according to the invention, affects the pressure force of the second prefolding rollers such that the force is increased as soon as the prefolded stack of sheets moves into the nip of the pressure rollers. The sheets are thereby compressed in a way so as not to slip on one another, which effects a reliable folding process.

The invention, and its object and advantages, will become more apparent in the detailed description of the preferred embodiment presented below.

BRIEF DESCRIPTION OF THE DRAWINGS

Further features and advantages can be inferred from the description of embodiments of the invention illustrated in the drawings and from the subclaims. The drawings show:

DESCRIPTION OF THE PREFERRED EMBODIMENT

Referring to the accompanying drawings, the sheet-folding device, according to the invention, is arranged on a finishing unit of a known type (not illustrated) in which individually supplied sheets, in particular copy sheets produced by a copier, for example, are collected in a collecting station to form a stack 17. As far as the finishing unit is concerned, only the components necessary for understanding the invention are shown. The finishing unit may be provided with a known stapling device (not illustrated) in which the sheets are first collected and stapled and them moved to the folding position shown in FIG. 1.

Figure 1:
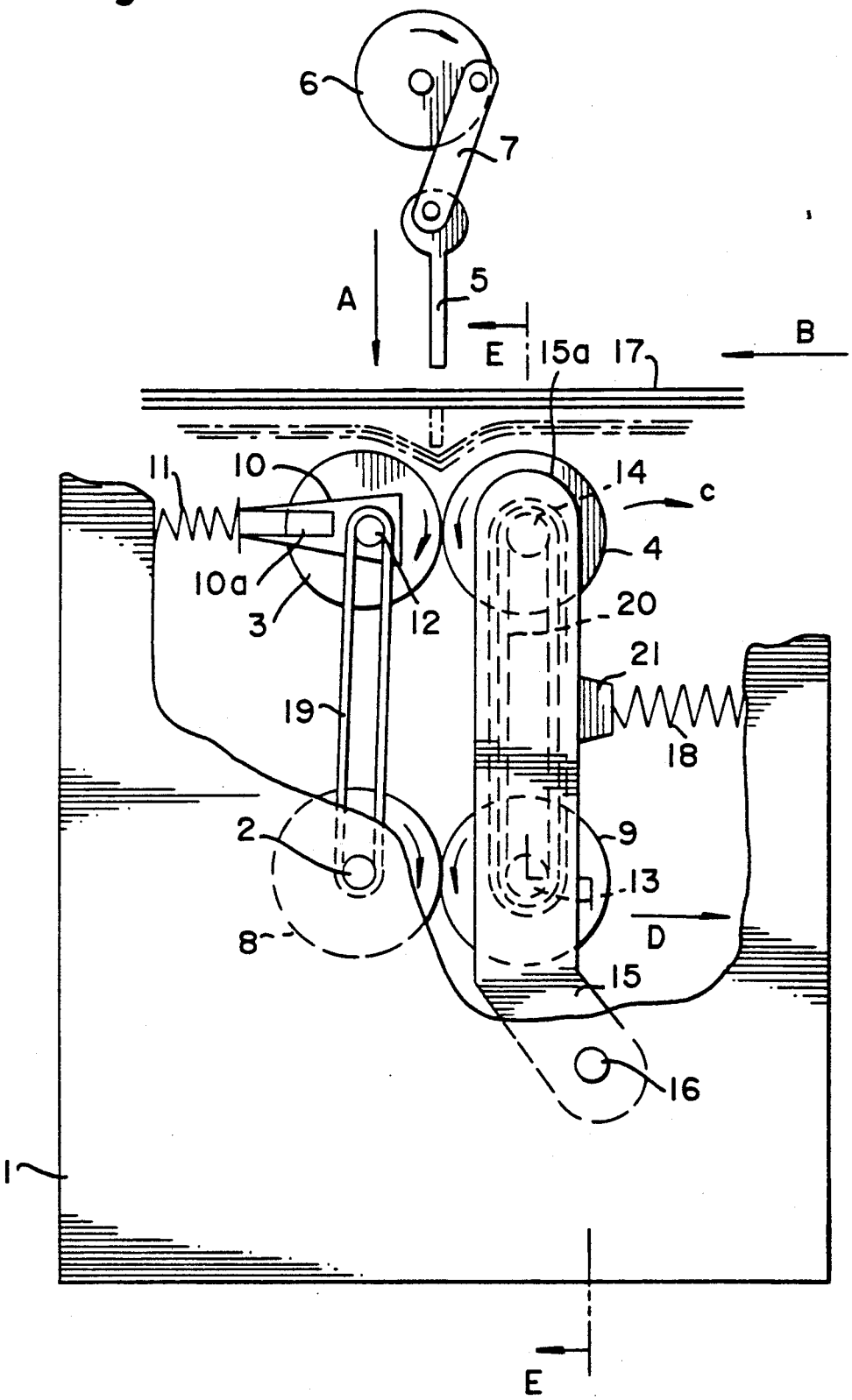
FIG. 1 shows a generally schematic side elevational view of the sheet-folding device according to the invention.

According to FIG. 1, the folding device features prefolding rollers 3, 4 and pressure rollers 8, 9. The rollers have identical diameters and are arranged in pairs parallel to each other. The rollers are supported on shafts 2, 12, 13 and 14 mounted in bearings in a machine frame 1, arranged in parallel and rigidly interconnected by means (not illustrated). Via traction gears having chains 19, 20, the prefolding and pressure rollers 3, 4 and 8, 9 are driven by a common drive motor (not illustrated) in the folding direction "A".

The first pressure roller 8 is stationarily mounted with its shaft 2 to machine frame 1 for rotation. The shaft 12 of the rotatable prefolding roller 3 is mounted on support members 10. Support members 10 are slidingly guided in respective slots (not illustrated) of machine frame 1, normal to the folding direction "A", by guide elements 10*a*. Support members 10 are urged by springs 11 in the sliding direction. The shaft 14 of the second rotatable prefolding roller 4 is mounted on the free ends 15*a* of lever arms 15, arranged on machine frame 1 to pivot about stationary shaft 16.

Figure 2:
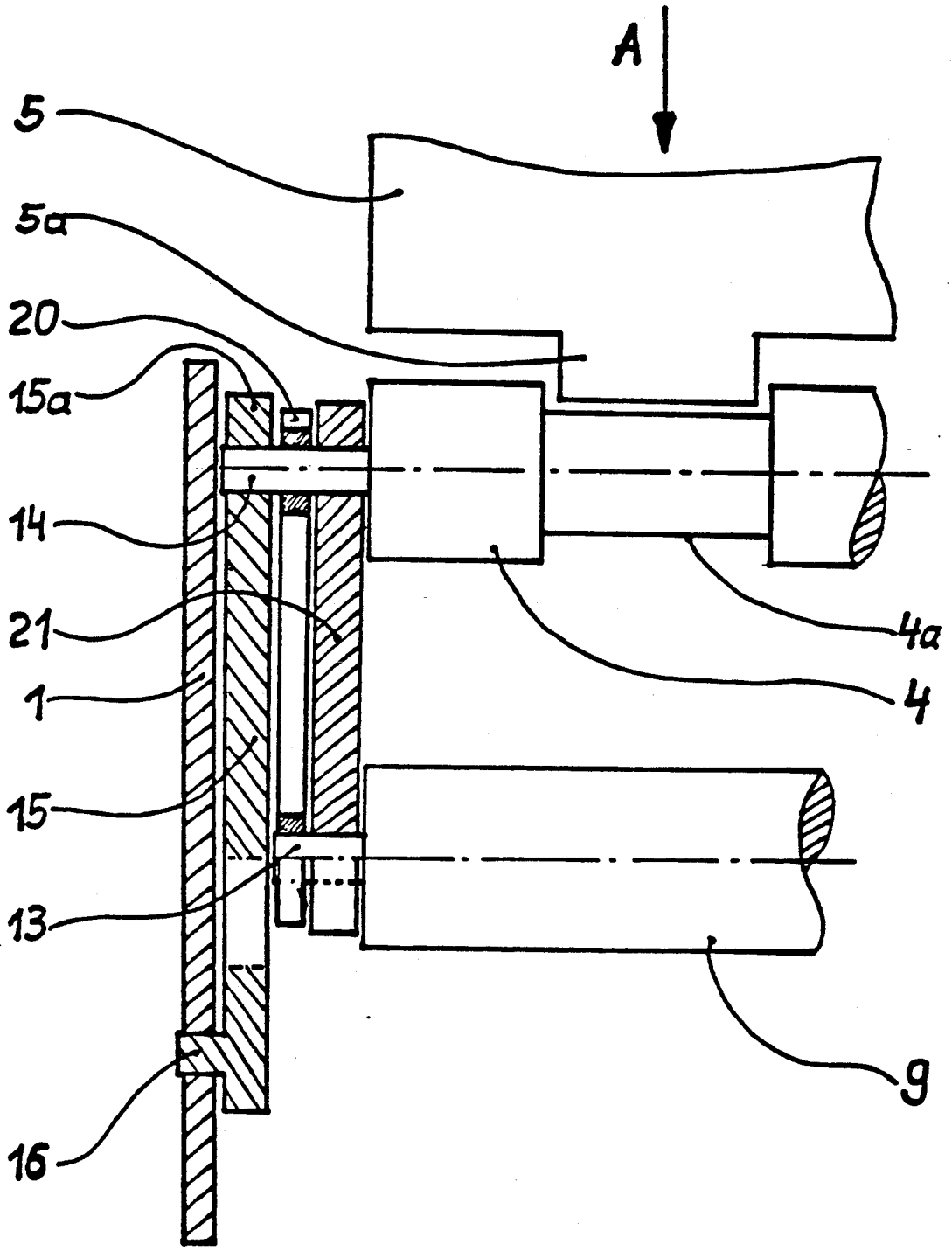
FIG. 2 is a partial view of the sheet-folding device according to FIG. 1 in cross-section, taken along line E—E of FIG. 1.

Connecting arms 21 are hinged at one end on shaft 14 supported by lever arm free ends 15*a* (see FIG. 2). The second pressure roller 9 is mounted for rotation about shaft 13 supported at the other end of connecting arms 21. The connecting arms 21 are urged by springs 18 (see FIG. 1) such that the second prefolding roller 4 and the second pressure roller 9 are urged toward the opposite prefolding and pressure rollers 3 and 8, respectively. The connecting arms 21 and the sections of the lever arms 15 extending between the shafts 13 and 14 are arranged parallel to the folding direction "A".

A known folding bar 5 is arranged above the prefolding rollers 3, 4. A drive mechanism 6, 7 serves to selectively push the folding bar between the prefolding rollers in the folding direction "A". According to FIG. 2, the prefolding rollers 3, 4 are provided with ring-shaped recesses 4*a* of a minor diameter which are arranged at intervals. Projections 5*a* of a comb-shaped folding bar 5 penetrate into recesses 4*a* in a known manner. In this way, the sheets to be folded can be deeply moved into the nip of the prefolding rollers 3, 4 without exerting a great force so that they can be reliably engaged.

The sheet-folding device operates as follows. The folding device is suitable both for folding an individual sheet and a plurality of sheets collected in the form of a stack and, in the latter case, for stapled or unstapled sheet stacks 17. The sheet stack 17 is moved in the direction of the arrow "B" and positioned at a stop (not illustrated) such that the folding line is located beneath the folding bar 5. By starting the drive mechanism 6, 7, the folding bar 5 is moved in direction "A", deforms the sheet stack 17 to take a V-shape, as indicated in FIG. 1 in dash-dotted lines, and is pushed into the nip of the prefolding rollers 3, 4.

The nip of the prefolding rollers 3, 4 widens by compressing the springs 11, 18 until the prefolded stack of sheets, transported in the direction "A", is engaged by the rollers. Folding bar 5 is then withdrawn opposite to the direction of arrow "A" by the drive mechanism 6, 7. When the nip of the prefolding rollers 3, 4 widens, the second prefolding roller 4 is pivoted in the direction of arrow "C", and thus springs 18 are compressed. The springs 11, arranged on the opposite side, are urged by sliding the support members 10, both pairs of springs 11 and 18 permitting the folding bar 5 to centrally penetrate into the nip of the prefolding rollers 3 and 4 and thus producing a correctly positioned fold irrespective of the number of sheets to be folded.

The prefolded stack of sheets is transported from the prefolding rollers 3, 4 to the pressure rollers 8, 9 and urge the second pressure roller 9 and thus the connecting arms 21 aside in the direction of arrow "D" by further compressing springs 18. The now increased compression of springs 18 enhances, via connecting arms 21, the pressure of the second prefolding roller 4 against the first prefolding roller 3 so that the prefolded stack advanced therebetween is transported at an increased pressure. This increases the frictional forces exerted on the prefolded stack, which is then advanced into the nip of the pressure rollers 8, 9 without having the possibility of avoiding them. At an increased pressure of the compressed springs 18, the pressure rollers 8, 9 complete the fold of the prefolded stack and advance it to a collecting bin (not illustrated).

As can be seen in FIG. 1, springs 18 engage the connecting arms 21 approximately in the middle between the two roller sheets 13 and 14. The pressure force of the second prefolding roller 4 can be adjusted or altered by changing the engaging point of springs 18, e.g., by means of a setting device (not illustrated). For example, the pressure force become greater the closer the springs 18 are positioned to shaft 14. The lever arms 15, shown in the drawing, can be stationarily supported in a different appropriate place of machine frame 1 or a component connected therewith. It is also possible not to hinge the connecting arms 21 on pivoting lever arms 15, as illustrated, but to mount them directly at the machine frame 1. For this purpose, it will then be necessary to locate the shaft 14 of the second prefolding roller 4 to which the connecting arms 21 are still hinged such that it is movable in the direction of the arrow "C" but is stationarily positioned in the direction of the arrow "A" (not illustrated). Due to the otherwise similar arrangement of the connecting arms 21 and springs 18, the operation of the pressure enhancement is the same as described above.

The above description and the drawings are confined to features which are essential to the invention. Those features which are disclosed in the description and in the drawing but are not mentioned in the claims also serve for defining the subject matter of the invention, if required.

We claim:

1. Device for folding at least one sheet, said sheet-folding device comprising:

first and second driven prefolding rollers (3, 4) supported in nip relation and first and second pressure rollers (8, 9) supported in nip relation, said first prefolding roller (3) and said first pressure roller (8), and said second prefolding roller (4) and said second pressure roller (9) arranged parallel to each other respectively and rotatably mounted successively in spaced relation to establish a sheet folding path lying in a plane between said first and second driven prefolding rollers and said first and second pressure rollers;

a folding bar for pushing at least one sheet in a folding direction (A) along said sheet folding path into the nip of said prefolding rollers by deforming such sheet to take a V-shape;

said first pressure roller (8) rotatably supported on a stationary shaft (2);

said first rotatable prefolding roller (3), arranged on the same side of said sheet folding path as said first pressure roller (8), stationarily mounted relative to the folding direction (A) along said sheet folding path and, urged in a direction perpendicular to said folding path;

said second prefolding roller (4) and said second pressure roller (9) rotatably mounted on connecting arms (21);

said second prefolding roller (4) stationarily rotatably mounted relative to the folding direction (A) along said sheet folding path and movable in a direction perpendicular to said folding path; and means (18) arranged between said second prefolding roller (4) and said second pressure roller (9), for urging them toward said first prefolding roller (3) and said first pressure roller (8), respectively, to establish a pressure force therebetween, said urging means engaging said connecting arms (21) such that the pressure force exerted by said second prefolding roller (4) is increased when sheets to be folded move into the nip of said pressure rollers (8, 9).

2. Device for folding sheets according to claim 1 including lever arms (15) pivotally mounted at one end about a stationary pivot shaft (16), and wherein said second prefolding roller (4) is supported by the end (15*a*) of said lever arms (15) opposite said one end.

3. Device for folding sheets according to claim 1 including slidingly guided and spring-urged support members (10, 10*a*), and wherein said first prefolding roller (3) is rotatably mounted on said support members (10, 10*a*).

4. Device according to claim 1 wherein said urging means includes a spring (18) mounted such that the pressure force of said second prefolding roller (4) is increased by compressing said springs (18).

* * * * *